US007694852B2

(12) United States Patent
Last

(10) Patent No.: US 7,694,852 B2
(45) Date of Patent: Apr. 13, 2010

(54) SYSTEM FOR DISPENSING A LIQUID SUBSTANCE

(75) Inventor: Laurens Last, Monte-Carlo (MC)

(73) Assignee: Nestec S.A., Vevey (CH)

( * ) Notice: Subject to any disclaimer, the term of this patent is extended or adjusted under 35 U.S.C. 154(b) by 1247 days.

(21) Appl. No.: 10/523,457

(22) PCT Filed: Jul. 30, 2002

(86) PCT No.: PCT/NL02/00516

§ 371 (c)(1),
(2), (4) Date: Sep. 13, 2005

(87) PCT Pub. No.: WO2004/011361

PCT Pub. Date: Feb. 5, 2004

(65) Prior Publication Data

US 2006/0144857 A1 Jul. 6, 2006

(51) Int. Cl.
*B65D 35/56* (2006.01)

(52) U.S. Cl. ..... 222/105; 222/129.1

(58) Field of Classification Search ..... 222/52, 222/83, 94, 105, 1, 129.1–129.4, 142.5, 142.3, 222/160, 207, 131, 132, 162, 179.5, 636, 222/325, 100

See application file for complete search history.

(56) References Cited

U.S. PATENT DOCUMENTS 4,561,567 A 12/1985 Wittstein et al.
4,655,266 A 4/1987 Ciekanski
4,856,676 A * 8/1989 Emody ..... 222/66
5,058,780 A 10/1991 Plester et al.
5,348,192 A * 9/1994 Sardynski et al. ..... 222/129.1
5,577,638 A * 11/1996 Takagawa ..... 222/185.1
5,603,432 A 2/1997 Sardynski et al.
5,732,853 A * 3/1998 Ganzeboom et al. ..... 222/82
5,885,533 A * 3/1999 Savage et al. ..... 422/102
6,802,460 B2 * 10/2004 Hess et al. ..... 239/306

(Continued)

FOREIGN PATENT DOCUMENTS

DE 35 10 843 C1 2/1987

(Continued)

OTHER PUBLICATIONS

Abstract of JP 9051852—Publication Date: Feb. 25, 1997 entitled "Coffee Dispenser".

*Primary Examiner*—Lien T Ngo
(74) *Attorney, Agent, or Firm*—K&L Gates LLP

(57) ABSTRACT

A system for dispensing at least one liquid substance comprises a bag filled with a substance which is to be dispensed and a dispensing device which has a housing in which there is a space for accommodating the bag. The bag has a first connector element and the dispensing device has a second connector element, connectable to the first connector element allowing discharge of said substance from the bag. The dispensing device has retaining means for retaining the first connector element of the bag in a defined pre-connection position prior to interconnecting the first and second connector elements. The first and second connector elements are displaceable relative to each other between a connected position and a disconnected position. The dispensing device has actuator means associated with the first or second connector elements for displacing the first and second connector elements relative to each other between the connected and unconnected position.

17 Claims, 4 Drawing Sheets

U.S. PATENT DOCUMENTS 6,871,015 B2 * 3/2005 Gutierrez et al. ..... 392/470

FOREIGN PATENT DOCUMENTS

EP 0 353 085 B1 11/1994
EP 1 006 415 A1 7/2000
WO WO 93/23327 11/1993
WO WO 02/26585 4/2002
WO WO 2004/011361 5/2004

* cited by examiner

SYSTEM FOR DISPENSING A LIQUID SUBSTANCE

BACKGROUND OF THE INVENTION

The present invention relates to a system for dispensing at least one liquid substance.

The system comprises at least one bag filled with a substance which is to be dispensed and a dispensing device which has a housing in which there is a space for accommodating the bag. The bag has a first connector element and the dispensing device has a second connector element, connectable to the first connector element allowing discharge of said substance from the bag.

SUMMARY OF THE INVENTION

A system as described above is generally known.

A drawback of the known system relates to the interconnecting of the first and second connector elements upon introduction of the bag into the dispensing device.

In some known systems the operator of the dispenser has to introduce the bag into the dispensing device and at the same time bring the first connector element into connection with the second connector element. This is often difficult to do and the operator can fail to bring about a reliable connection.

In other known systems the operator has to grab both the first and second connector elements and bring them together which suffers from the same drawbacks.

It is an object of the invention to provide a dispensing system allowing an efficient and reliable interconnection of the first and second connector elements.

It is another object of the invention to provide a dispensing system allowing the use of an assembly of multiple bags each having an associated first connector element.

It is a yet another object of the invention to provide a bag-in-box assembly, advantageously usable in the system of the invention.

The invention achieves the first mentioned object by providing a system according to the preamble of claim 1, which is characterised in that the dispensing device comprises retaining means for retaining the first connector element of the bag in a defined pre-connection position prior to interconnecting the first and second connector elements, and in that the first and second connector elements are displaceable relative to each other between a connected position and a disconnected position, and in that the dispensing device has actuator means associated with the first or second connector element for displacing the first and second connector elements relative to each other between the connected and unconnected position.

In one embodiment the second connector element is mounted stationary in the dispensing device and the bag provided with the first connector element is displaceable.

In a preferred embodiment the second connector element is displaceable in the dispensing device.

The invention thus provides for an exact positioning and retaining of the first connector element—either in a predetermined fixed position in the dispensing device or by means of an actuator means co-operating with a displaceable first connector element—prior to the relative displacement of the first and second connector elements towards the connected position thereof. This avoids the problems associated with the prior art systems and guarantees a reliable interconnection of the connector elements.

The invention also allows for a more convenient and rapid connector of a flexible bag to the dispensing device.

Preferably in the disconnected position the second connector element is located outside the space for housing the bag. This avoids the risk that the second connector element is damaged upon introduction or removal of the bag from the dispensing device.

In a preferred embodiment the housing of the dispensing device allows insertion and removal of the bag in a first direction (i.e. horizontally) and the second connector element is displaceable in another second direction, preferably at right angles to the first direction (i.e. vertically).

In a preferred embodiment the space in the housing is adapted to receive an assembly of multiple bags, and each bag is provided with an associated first connector element, and a base element is provided interconnecting the first connector elements of the bags. The base element guarantees the exact pre-connection position of the first connector elements of the bags either onto the housing of the dispensing device or onto the actuator means.

The bags are usually flexible and collapsible. Therefore, the base element also allows for an increased rigidity of the bags in the region of the first connector elements.

In a preferred embodiment the system comprises a carrier member for one or more bags, preferably a box in which one or more bags are accommodated. This allows for an easy handling of the one or more bags. The box can e.g. be made of plastic. The box can be provided with a handle for handling of the box.

In a preferred embodiment the retaining means of the dispensing device are adapted to retain the base element and thereby the multiple first connector elements of the bags. In a practical embodiment the retaining means are adapted to slidingly receive the base element.

In a preferred embodiment the first connector elements and base element are interconnected by snap means. This allows the production of bags fitted with first connector elements in a known manner and then interconnecting the bags using the base element in a simple manner before or after filling of the bags.

In a preferred embodiment the dispensing device has multiple second connector elements mounted on a common support, said common support being displaceable between a connected and an unconnected position.

In order to avoid premature displacement of the second connector elements it is preferred that the dispensing device comprises detector means for detecting the presence in the space in the housing of a bag or a carrier of one or more bags, and that the detector means are interconnected to the actuator means so that the second connector element(s) is or are only displaceable towards the connected position if the presence of the bag or a carrier of one or more bags is detected.

In a practical embodiment the detector means comprise a mechanical detector contacting a part of the bag, assembly of bags, or carrier.

In a preferred embodiment the detector means are adapted to detect the presence of the base element associated with an assembly of interconnected bags.

In a practical embodiment a latch is associated with the actuator means, said latch preventing displacement of the second connector element(s) towards the connected position if no bag, assembly of bags or carrier is detected.

In a preferred embodiment the common support for multiple second connector elements comprises a removable support member on which the second connector elements are mounted. This allows e.g. the cleaning of the second connector elements, the exchange of the removable member so that other second connector elements are provided, etc.

In a practical embodiment the actuator means comprise rectilinear guide means for guiding the second connector element or the common support of multiple second connector elements.

In a preferred embodiment the actuator means comprise a moveable, e.g. slideable member, moveable at right angles to the rectilinear guide means and interconnected to the second connector element or the common support of multiple second elements by a cam mechanism. Preferably said cam mechanism comprises an interengaging slot and follower. Advantageously the slot is provided in the slideable member and the follower is mounted on the common support.

In a preferred embodiment a removable or pierceable seal is fitted on the base element covering the openings of the first connector elements. This avoids contamination of the openings of the first connector elements.

In a preferred embodiment each first connector element is associated with a closing means closing off the bore of the first connector element prior to interconnecting the first and second connector element.

In a further preferred embodiment thereof the closing means is a plug engaging a seat of the first connector element in the closed position, which plug is displaceable from the seat to an opened position upon connecting the first and second connector element.

In a preferred embodiment the first connector element is a female connector element having a bore and the second element is a male connector element fitting into said bore.

In case of an assembly of multiple bags it is foreseen that each bag is filled with a different substance. In order to avoid incorrect connection between the bags and the dispenser device it is preferred that the base element and the retaining means comprise interengaging key formations so that the base element can only be retained in a particular orientation by said retaining means.

In a preferred embodiment the base element is an elongated strip having a series of spaced receiving openings for receiving the first connector elements of the bags. In a practical embodiment the strip has retaining rails at opposite longitudinal sides thereof and the retaining means include retaining grooves for slidingly receiving the retaining rails.

A particular advantageous application of the invention is that the dispenser device is a postmix beverage dispenser device having mixing means for mixing the one or more liquids with water.

The present invention also relates to an assembly of bags filled with liquid, each bag having an associated first connector element connectable to a second connector element of a dispensing device and the first connector elements being interconnected by a base element.

The present invention also relates to a bag-in-box assembly comprising a box member and an assembly of bags therein.

The present invention also relates to a method for filling an assembly of multiple bags with liquid substances, each bag having an associated first connector element and a closing means for closing the first connector element after filling, wherein the bags of the assembly are interconnected prior to filling by a base element interconnecting the first connector elements of the bags, after which the bags are filled, preferably simultaneously, and closed.

Additional features and advantages of the present invention are described in, and will be apparent from, the following Detailed Description of the Invention and the figures.

BRIEF DESCRIPTION OF THE FIGURES

The invention will now be explained further in detail referring to the drawing, wherein.

DETAILED DESCRIPTION OF THE INVENTION

In FIGS. 1-4 the relevant parts of a system for dispensing a liquid substance are shown.

In this example the system comprises a postmix beverage dispenser device having mixing means for mixing the one or more liquid substances with water. In particular the system shown here is designed for dispensing two substances from two separate bags, e.g. two substances which are then mixed with water to obtain a beverage, e.g. coffee.

Figure 1:
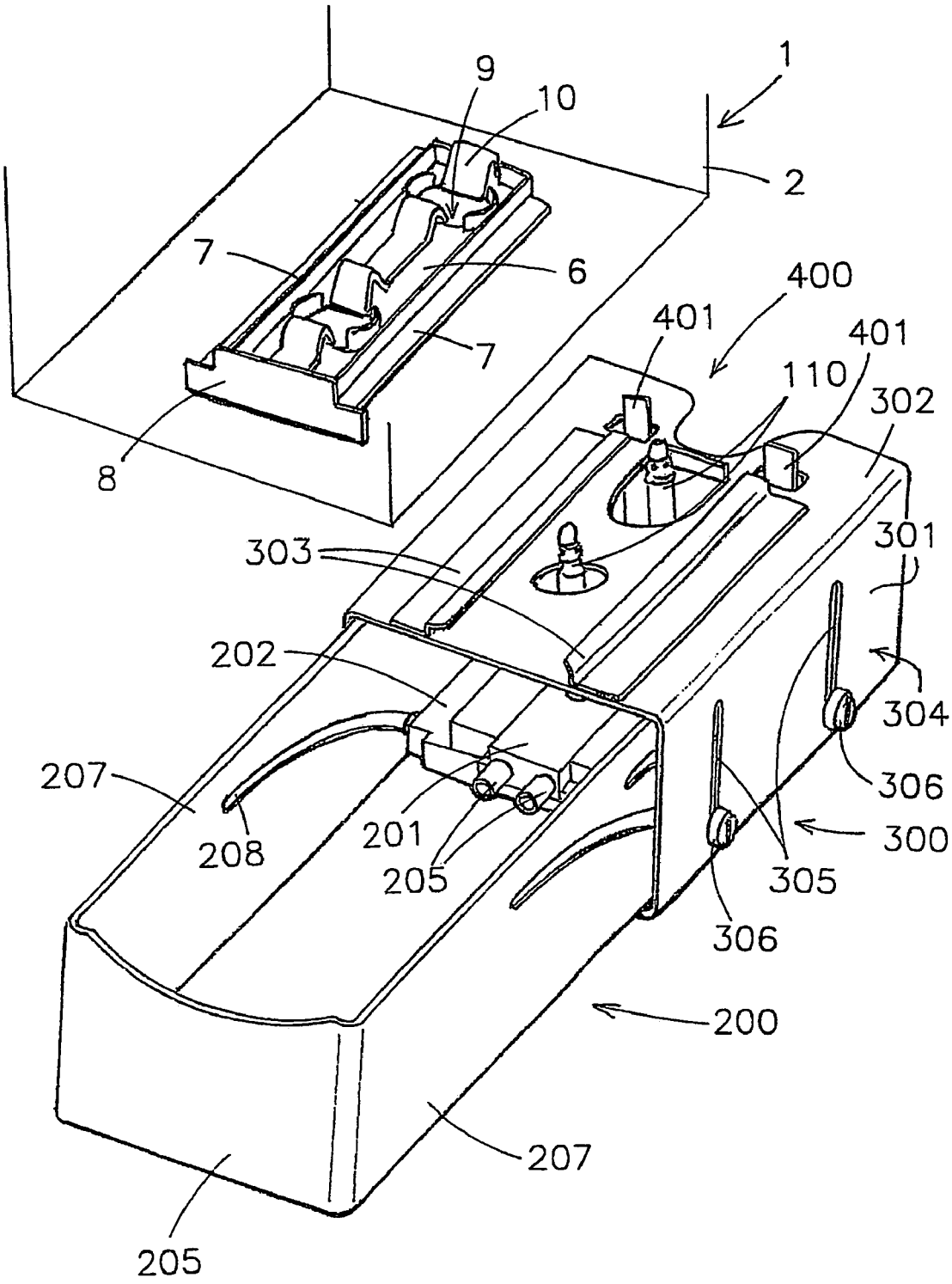
FIG. 1 schematically shows a part of a system according to the invention.
Figure 1A:
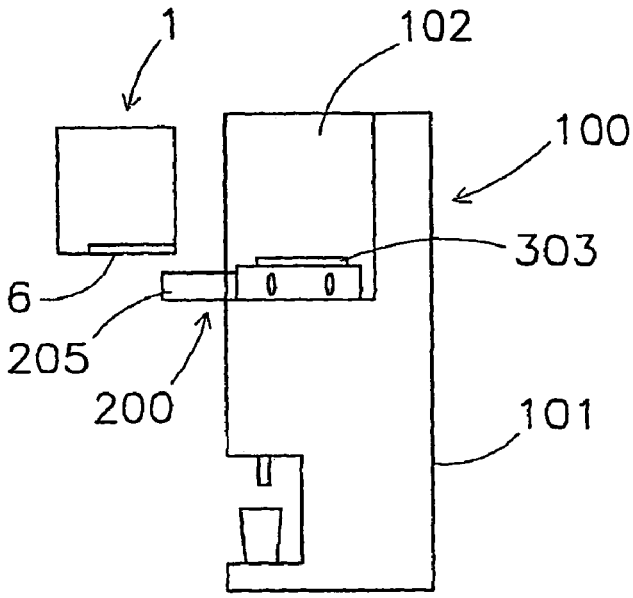
FIG. 1*a* shows in cross-section a dispensing of the system of FIG. 1.
Figure 2:
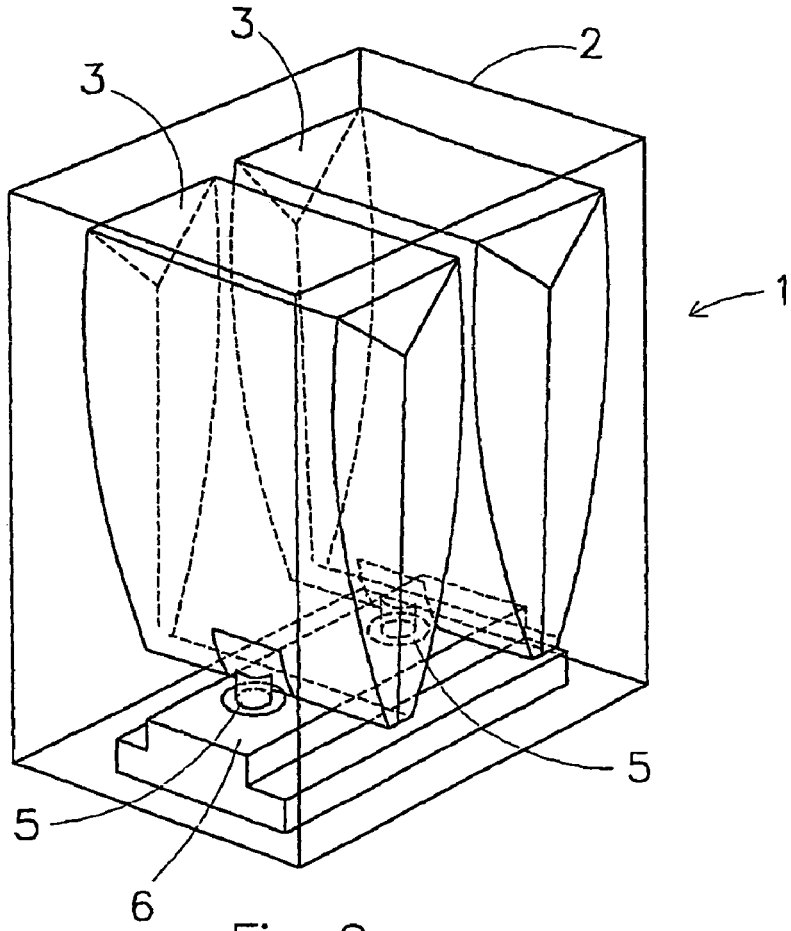
FIG. 2 a bag-in-box according to the invention.

The system comprises a bag-in-box assembly 1, shown partly in FIG. 1 and in more detail in FIG. 2, and a dispensing device 100 (see FIG. 1*a*) e.g. a coffee-dispensing device. Of this device 100 only the relevant part is shown as will follow from this description.

The dispensing device 100 has a housing 101 in which there is a space 102 for accommodating the bag-in-box assembly 1.

The bag-in-box assembly 1 has a box 2 in which two collapsible bags 3 are accommodated each filled with a liquid substance.

The bags 3 are in this example identical, so that the same parts are denoted with the same reference numerals.

Each bag 3 has a first connector element 5, here sealed in the bottom end of the bag 3.

A base element 6 (shown in detail in FIG. 4) is provided interconnecting the first connector elements 5 of the bags 3.

The first connector elements 5 and base element 6 are interconnected by snap means 7.

The dispensing device 100 has two second connector elements 110, each connectable to a first connector element 5 allowing discharge of said substance from the associated bag 3.

Associated with the second connector elements 110 are actuator means 200, which allow for a displacement of these second connectors 110 relative to the first connector elements 5 between a connected position and an unconnected position.

Figure 3:
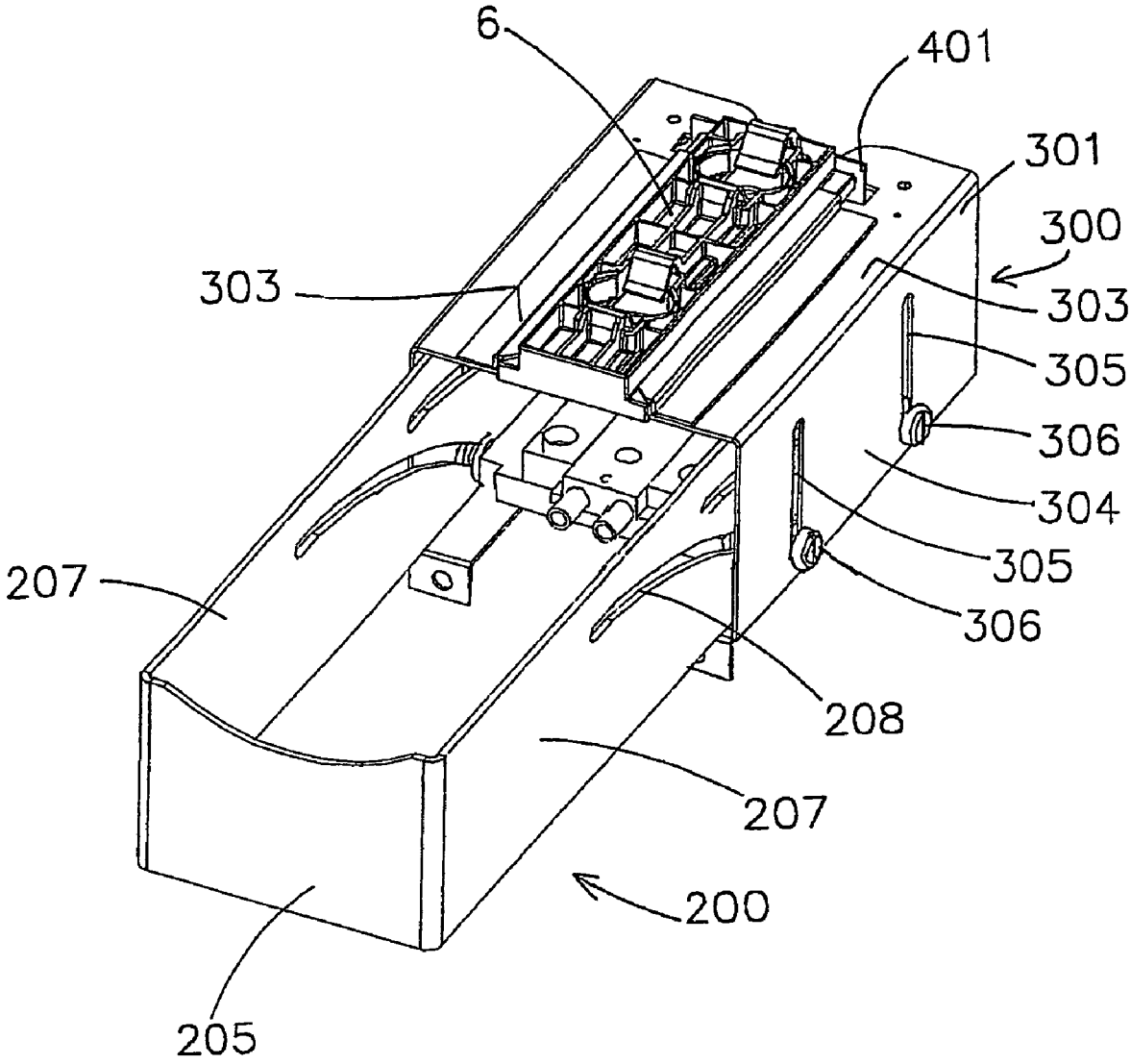
FIG. 3 the actuator means for the second connector elements of the dispensing device, and FIG. 4*a,b* the base element and first connector elements of the assembly of bags of the bag-in-box assembly of FIG. 2.
Figure 4A:
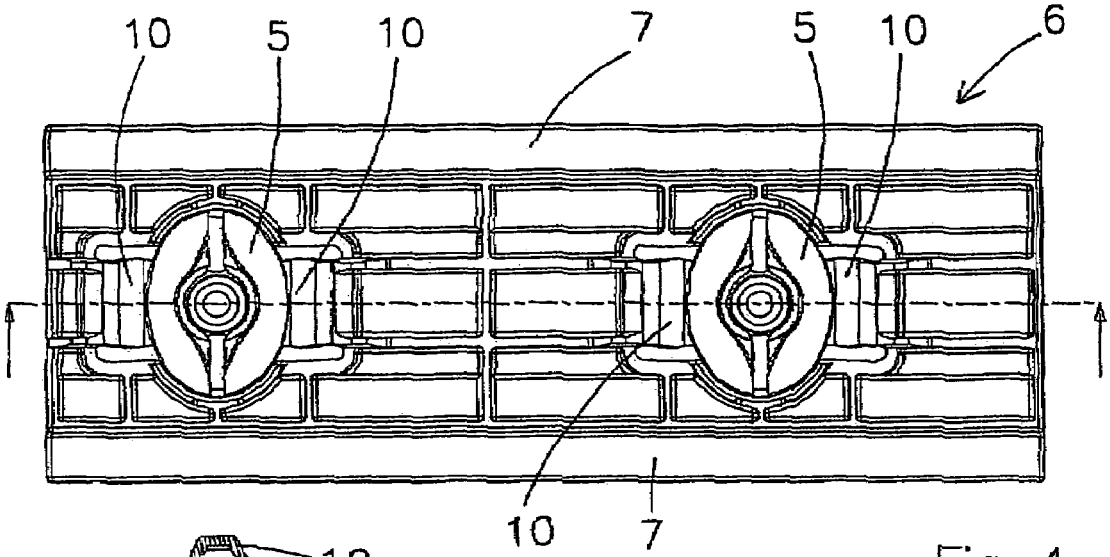
Figure 4B:
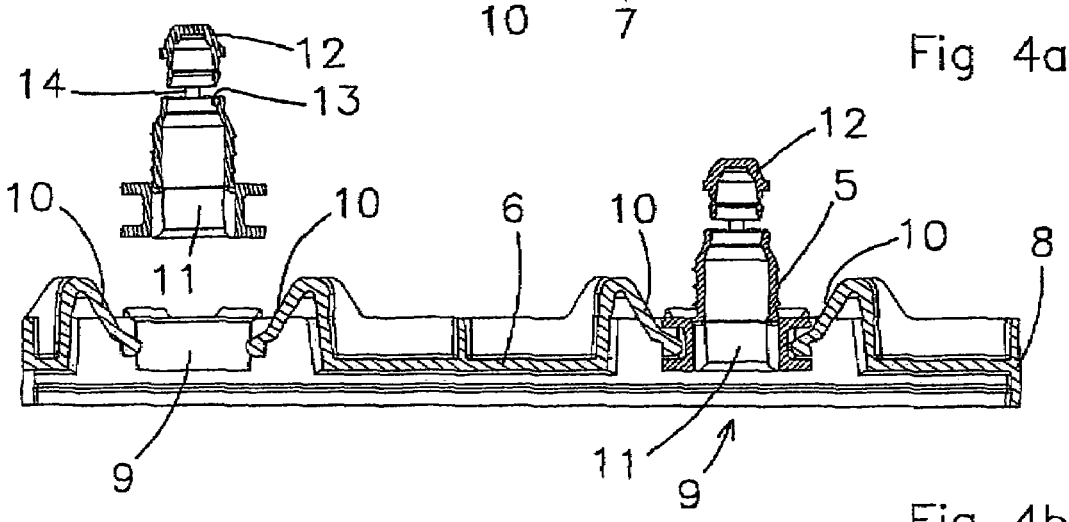

A preferred embodiment of these actuator means 200 is disclosed in detail in FIGS. 1 and 3.

The dispensing device 100 is provided with retaining means 300 for retaining the first connector elements 5 of the bags 3 in a defined pre-connection position prior to interconnecting the first and second connector elements 5, 110. These retaining means 300 are located here at the bottom side of the space 102, so that the bag-in-box is placed on top of those retaining means 300. The retaining means 300 are adapted to cooperate with the base 6 and thereby retains the first connector elements 5.

In the preferred embodiment shown in the drawing the retaining means 300 comprise a bracket 301 having a top face 302 on which two parallel rails 303 are mounted. The rails 303 are directed in the insertion direction of the bag-in-box 1 into the space 102. The base 6 is provided with rails 7 at opposite side thereof, so that the rails 7 slidingly co-operate with rails 303 of the retaining means 300.

The base 6 has an abutment 8 at one end of the rails 7 which comes into contact with the stern faces of the rails 303 and thereby the pre-connection position of the base 6 and thus of the associated first connectors 5 is defined. The abutment 8 and the rails 303 thus also act as key formations so that the base 6 can only be retained in a particular orientation by said retaining means 300. It will appreciated that this is in particular relevant if the bags 3 contain different substances.

In the disconnected position the second connector elements 110 are located below the top face 302 of the bracket as is shown in FIG. 3 and thus outside the space 102 for housing the bag-in-box assembly 1. In FIG. 1 the second connectors 110 are shown above said top face 302 only to illustrate the presence of these connector elements 110, in fact they should also be located below the top face 302 in this FIG. 1.

The top face 302 of the bracket 301 is provided with apertures which allow the passage of the second connector elements 110 upon connection of the second connector elements 110 to the first connector elements 5.

In the preferred embodiment shown here the insertion direction of the base 6 into the bracket 301 is essentially horizontally and the direction of the displacement of the second connectors 110 is essentially vertically. It will be clear that other arrangements are possible as well, including an arrangement wherein the base 6 is on top of the bag-in-box assembly.

The second connector elements 110 are mounted on a common support 201, which common support 201 is displaceable between a connected and an unconnected position.

This common support 201 is embodied here as a removable common support 201, which is held by an associated member 202 of the actuator means 200.

The common support 201 includes two liquid channels connecting to the second connector elements 110 having sockets 205 for connecting said channels to a corresponding hose (not shown). The removal of the support 201 allows replacement in case second connector elements 110 are needed of a different design and/or if the second connector elements 110 have been worn out and/or for cleaning purposes.

The actuator means 200 in this embodiment comprise a slideable member 205, which is slideable here in horizontal direction by hand.

The bracket 300 has parallel side walls 304 each provided with two rectilinear guide slot 305 which are directed in the direction of displacement of the second connector elements 110.

The member 202 is provided with bosses, here formed by bolts 206, extending through said slots 305. As such the member 202 and thus the second connector elements 110 are displaceable in the vertical direction only.

The slideable member 205 has two parallel limbs 207, each slidingly along an associated side wall 304 of the bracket 300.

In each limb 205 two slots 208 are formed and the bolts 206 also each extend through one of these slots 208. This results in the effect that upon pushing in the member 205 towards the bracket 300 from the starting position shown in FIGS. 1-3, the bosses 206 are pushed upwards by the limbs 206 as these bosses 206 follow the slots 208. It will be clear that the slots 208 are placed at a generally inclined position to effect the upward displacement of the member 202. The shape of the slots 208 may vary.

A biasing means, such as a spring can be provided to bias the slideable member 205 to the position associated with the unconnected position of the second connector elements 110.

In order to prevent that the second connector elements 110 do effectively protrude above the top face of the bracket 301 before the bag-in-box 1 is inserted—which would damage the second connector elements 110—provision is made for detector means 400 for detecting the presence of the bag-in-box 1 at the pre-connection position. An associated latch ensures that only when this correct position is detected the actuator means 200 can be operated.

In this embodiment the detector means 400 comprises two mechanical sensors 401 which are contacted by the base 6 only upon full insertion of the base 6 into the retaining means 300. These sensors 401 co-operate with a mechanical latch (not shown) which normally prevents the movement of the slideable member 205.

In order to place a bag-in-box 1 into the dispensing device 100 the operate will open a door or the like associated with the space 102 upon which the slideable member 205 will assume the position shown in FIG. 1 if no bag-in-box 1 is already connected.

Then the operator will place the bag-in-box assembly 1 in the space 102 whereby the base is slidingly connected to the bracket 300. Only when the correct pre-connection position of the base 6 is reached, the sensors 401 effect the unlatching of the slideable member 205. The operator can now push this member 205 inward and thereby effect the upward displacement of the second connectors 110 to the connected position.

It will be clear that the actuator means 200 can be power operated if desired.

Also it will be clear that the second connector elements 110 could be arranged in a stationary manner in the dispensing device 100 and that the actuator means 200 would be used to displace the first connector elements 5. In fact this already is the case if the member 202 would be mounted stationary in the dispensing device 100. Pushing the slideable member 205 inwards would then have the effect of displacing the base 6 and the first connectors 5 downwards so that the connection is established.

In a variant not disclosed in the drawings the dispensing device comprises a mechanism for displacing the bag (or bag-in-box) with respect to the retaining means. In this example the mechanism could be used to slide the bag-in-box from the retaining rails 303 and/or sliding the bag-in-box into the retaining means. This is in particular advantageous if the retaining means would require a vertical movement of the bag or bag-in-box. In a preferred embodiment this mechanism could include a hand-operable lever.

In another embodiment a lever could be used to actuate one or more displaceable second connector elements, e.g. as a substitute of or in cooperation with the sliding member as disclosed hereabove.

The base 6 is in the form of an elongated strip having a series of spaced receiving openings 9 for receiving the first connector elements 5 of the bags 3. The rails 7 are located at opposite longitudinal sides of the base 6.

One or more resilient snap members 10 are placed at each opening 9 to effect the snap connection of the first connector elements 5 to the base 6.

In the embodiment shown here the first connector elements 3 are female connector elements 3 and have a body provided with a bore extending from an insertion opening for the second connector element 110 (embodied as a male connector element) to an opening inside the bag 3.

In order to prevent contamination of the bore 11 and as a tamper evident a removable or pierceable seal is preferably fitted on the base element 6 covering the openings of the first connector elements 5 (not shown in the drawings).

Each first connector element 5 here further has a closing means in the form of a plug 12 for closing off the bore 11 of the first connector element prior to interconnecting the first and second connector elements 5,110.

The plug 12 engages a seat 13 of the first connector element 5 in the closed position. The plug 12 is displaceable from the seat to an opened position upon connecting the first and second connector element 5, 110. The plug 12 here is connected by a flexible arm 14 to the body of the connector element 5.

The second connector elements 110 are male connector elements 110 each having a tubular body with a head which interengages with the plug 12.

The base 6 is advantageous for the handling the two bags 3, in particular when assembling the bag-in-box assembly 1. Also the base 6 is advantageous when filling an assembly of multiple bags with liquid substances, each bag having an associated first connector element and a closing means for closing the first connector element after filling. Then the bags are preferably interconnected prior to filling by the base 6 interconnecting the first connector elements 5 of the bags 3, after which the bags 3 are filled, preferably simultaneously, and closed.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the housing of the dispensing device allows insertion and removal of the bag in a first direction and the second connector element is displaceable in a second direction.

2. A system according to claim 1, wherein the housing of the dispensing device allows insertion and removal of the bag in a horizontal direction.

3. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the dispensing device comprises detector means for detecting the presence in the space in the housing of a bag or a carrier of one or more bags.

4. System according to claim 3, wherein the detector means are interconnected to the actuator means so that the second connector element is only displaceable towards the connected position if the presence of the bag or a carrier of one or more bags is detected.

5. System according to claim 4, wherein the detector means comprise a mechanical detector contacting a part selected from the group consisting of the bag, assembly of bags, or carrier.

6. System according to claim 4, wherein the detector means comprise a mechanical detector.

7. System according to claim 6, wherein the detector means are adapted to detect the presence of the base element associated with an assembly of interconnected bags.

8. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein a latch is associated with the actuator means, said latch preventing displacement of the second connector element towards the connected position if no bag, assembly of bags or carrier is detected.

9. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the space in the housing is adapted to receive an assembly of multiple bags, each bag being provided with an associated first connector element, and wherein a base element is provided interconnecting the first connector elements of the bags, and wherein the dispensing device has multiple second connector elements mounted on a common support, said common support being displaceable between a connected and an unconnected position and comprising a removable support member on which the second connector elements are mounted.

10. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the actuator means comprise rectilinear guide means for guiding the second connector element.

11. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the actuator means comprise a slideable member that is slideable at right angles to rectilinear guide means and interconnected to the second connector element by a cam mechanism.

12. System according to claim 11, wherein said cam mechanism comprises an interengaging slot and follower.

13. System according to claim 12, wherein the slot is provided in the slideable member and the follower is mounted on a common support of the second elements.

14. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the dispensing device is a postmix beverage dispensing device having mixing means for mixing the one or more liquids with water.

15. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the space in the housing is adapted to receive an assembly of multiple bags, each bag being provided with an associated first connector element, and wherein a base element is provided interconnecting the first connector elements of the bags, and wherein a seal is fitted on the base element covering the openings of the first connector elements and the seal is pierceable.

16. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the actuator means comprise rectilinear guide means for guiding a common support of multiple second connector elements.

17. System for dispensing at least one liquid substance, comprising:

at least one bag filled with a liquid substance which is to be dispensed, a dispensing device comprising a housing having a space for accommodating the bag, the bag comprising a first connector element and the dispensing device comprising a second connector element, connectable to the first connector element allowing discharge of said substance from the bag, the dispensing device further comprising retaining means for retaining the first connector element of each bag in a defined pre-connection position prior to interconnecting the first and second connector elements, the first and second connector elements being displaceable relative to each other between a connected position and a disconnected position, and the dispensing device comprising actuator means associated with the first or second connector elements for displacing the first and second connector elements relative to each other between the connected and unconnected position, wherein the actuator means comprise a slideable member that is slideable at right angles to rectilinear guide means and interconnected to a common support of multiple second elements by a cam mechanism.

* * * * *